US006234712B1

(12) United States Patent
Flader et al.

(10) Patent No.: US 6,234,712 B1
(45) Date of Patent: May 22, 2001

(54) REDUCED IMPACT LOAD SNOWPLOWABLE PAVEMENT MARKER

(75) Inventors: Michael E. Flader, Chicago; Anish A. Desai, Hoffman Estates; Jacob E. Steele, Chicago; Stephen M. Bednarz, DeKalb, all of IL (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/454,725

(22) Filed: Dec. 4, 1999

(51) Int. Cl.[7] ..... E01F 9/06; E01F 9/08; E01F 11/00

(52) U.S. Cl. ..... 404/14; 404/16; 404/12; 116/63 R

(58) Field of Search ..... 404/12, 13, 14, 404/15, 16; 116/63 R

(56) References Cited

U.S. PATENT DOCUMENTS 4,195,945 4/1980 Heenan .
5,257,875 11/1993 Flanagan .
5,277,513 1/1994 Flanagan et al. .

*Primary Examiner*—Thomas B. Will
*Assistant Examiner*—Alexandra K. Pechhold
(74) *Attorney, Agent, or Firm*—Jones, Day, Reavis & Pogue

(57) ABSTRACT

A snowplowable pavement marker includes a frame member having primary spaced keel members with ramp surfaces which have upwardly inclined contours beginning at a forward end portion of each keel member and extending at a first acute angle, then transitioning to a second portion having a second acute angle which is greater than the first angle. Further, the frame member includes an auxiliary keel member having ramp surfaces disposed between the primary keel members and having the same contour as the primary ramp surfaces. The auxiliary keel member ramp surfaces extend inwardly of the frame member to a point proximate the marker's reflector and serve to prevent damage by a snowplow blade set at a wide angle to the direction of blade travel. Advantageously, the contour of ramp surfaces permits a higher frame member installation above the pavement and allows for greater exposure of the reflector.

27 Claims, 4 Drawing Sheets

REDUCED IMPACT LOAD SNOWPLOWABLE PAVEMENT MARKER

BACKGROUND OF THE INVENTION

1. Field of the Invention

The present invention relates generally to snowplowable pavement marker construction and, more particularly, to pavement markers which impart reduced impact forces when struck by a plow blade during a snowplowing operation.

2. Description of the Related Art

Pavement markers have long been widely accepted as permanently installed devices for providing visible signals which delineate traffic lanes of highways and control the flow of traffic in conjunction with or in place of painted traffic lines. A large number of such markers employ reflectors which retroreflect light emanating from oncoming vehicle headlights to provide a visible signal to operators of such vehicles.

It is also common that in regions where frequent snow fall is experienced the reflectors are protected from snowplow damage by metal frame devices which hold the reflectors firmly to the pavement and serve to deflect a snowplow blade thus preventing the blade from stripping or breaking the reflectors. Such devices are disclosed, for example, in Heenan U.S. Pat. No. 4,195,945, Flanagan U.S. Pat. No. 5,257,875 and Flanagan et al. U.S. Pat. No. 5,277,513, all which are commonly assigned to the assignee herein. In the '945 patent, for example, snowplowable pavement markers are disclosed which include a metal frame, or base member, having two arcuate bottom keel members interconnected by an arcuate bottom support member. The upper surfaces of the keel members define inclined ramps from a plane at one end of the base member toward the other end thereof to corresponding coplanar top surfaces. The support member has a support surface lying below the plane for supporting thereon a retroreflector which is partially recessed below the plane. The keel members and the support member are secured in complementary arcuate recesses in the pavement with the plane of the retroreflector support surface being slightly below the pavement surface.

In designing these prior art snowplowable pavement markers it has been a continuing goal to reduce the overall height of the marker frame member to a minimum level above the pavement surface without undesirable reduction of the retroreflectance of the marker and, accordingly, the visibility of the marker. In this regard it has heretofore been recognized that the angle between the pavement surface and the inclined ramps of the frame members should be minimized to reduce impact of a snowplow bade on that portion of the frame member projecting about the pavement surface. This is so because not only can such impact damage or destroy the frame member it can cause significant jolting of the snowplow vehicle during a plowing operation. However, although the ramp angle theoretically could be reduced as low as desired, a lower ramp angle generally requires a longer ramp and thus a longer frame member to maintain the same reflector height above the pavement surface. Not only would a longer frame be heavier and more costly, it would require specialized equipment to install. Also, current frame member designs typically use either a series of ramp slopes to guide the blade over the reflector or, in some cases, these slopes are rounded off into a convex shape. A disadvantage of these designs is that they produce large strike forces when plowing is performed at pavement level.

Another goal in the design of snowplowable pavement markers has been to design such markers in which the retroreflector members are adequately protected from snowplow blade damage when the blade is set at a large angle relative to the direction of vehicle travel. Generally, common retroreflector members are made of plastic materials which can easily be damaged by a heavy metal plow blade. To this end, the aforementioned '875 patent discloses a type of pavement marker specifically designed to protect the reflector against the action of a snowplow blade set at an angle of up to sixty degrees from a line extending perpendicular to the direction of travel of the snowplow vehicle. This is particularly advantageous where the tip of a snowplow blade, set at such a large angle, could intrude between the pavement marker ramps and contact the reflector. Such larger angles typically are desired in extremely heavy snow areas where high speed plowing is common, such as on interstate roads. The '875 device, which is a one-way plowable device, has two spaced-apart primary ramp members joined by a body portion. An auxiliary ramp member is centrally positioned on the front of the body portion between the primary ramp members and serves to support a snowplow bade when the blade tip is located between the two primary ramp members.

Although the aforementioned pavement markers have gained considerable commercial acceptance and are now in widespread use, it is desirable to provide a snowplowable pavement marker that is of a standard length yet exhibits reduced effect of impact loads when struck by snowplow blades and is sufficiently high above the pavement as to allow for the use of a reflector which can be readily seen by an oncoming motorist. It is further desirable to provide such a pavement marker which is capable of deflecting a snowplow blade that is set at a relatively large angle relative to its direction of travel thus preventing possible damage to the marker's reflector. Still further it is desirable to provide such a pavement marker which is readily constructed by known manufacturing techniques and is cost-effective to produce.

SUMMARY OF THE INVENTION

The present invention improves over the prior art by providing a snowplowable pavement marker including a frame member having primary spaced keel members with ramp surfaces which are upwardly concave in contour. Thus, snowplow blade impact forces are reduced substantially for a given height of the frame member ramp surfaces above the pavement. Further, the frame member includes an auxiliary keel member having ramp surfaces disposed centrally between the primary ramp surfaces and having the same concave contour as the primary ramp surfaces. The auxiliary keel member ramp surfaces extend inwardly of the frame member to a point proximate the marker's reflector member and serve to prevent damage of the reflector by a snowplow blade set at a wide angle to the direction of blade travel. Advantageously, the concave ramp contours permit a higher frame member installation above the pavement, and consequently a larger reflector, and allow for greater exposure of the reflector despite the presence of the auxiliary ramps.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
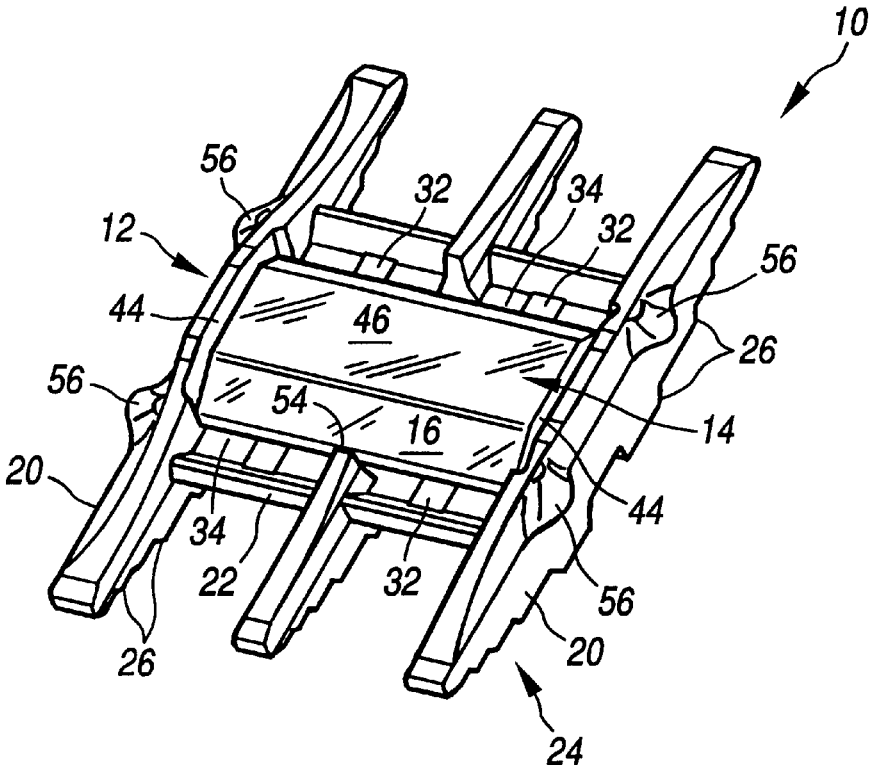
FIG. 1 is a top perspective view of a pavement marker constructed in accordance with the principles of the invention.

Referring now to the drawings, and initially to FIG. 1, a snowplowable pavement marker constructed according to the invention is designated generally by the reference number 10 and includes as its principal components a frame member 12 to which a reflector 14 is fitted. The reflector 14 is preferably of a type well-known in the art constructed with forwardly and rearwardly projecting lenses 16, only one of which can be seen. The reflector 14 may be selected from a variety of known signal devices such as those disclosed in U.S. Pat. No. 4, 195,945, issued to Heenan on Apr. 1, 1980, and U.S. Pat No. 4,340,319, issued to Heenan et al. on Jul. 20, 1982, both commonly assigned herewith. It will be appreciated that while the invention may be practiced in the form of a one-way snowplowable pavement marker such as of the type disclosed in the aforementioned '875 patent, the illustrated embodiment of pavement marker 10 is a bidirectional snowplowable marker. To this end the marker 10 is constructed as to be generally symmetrical about a transverse line drawn through the center of the marker 10 as well as about a longitudinal line drawn through the center of the marker 10.

The frame member 12 is preferably formed of a relatively high-strength material, such as pearlitic ductile iron, grade D5506, DAE J434 with a cast hardness of 179–255 Brinell or grade D7003, SAE J434C with a hardness of 241–302 Brinell. It includes as its principal components a pair of longitudinally directed spaced primary keel members 20 connected by a support member 22. In a manner well-known in the art, the keel members 20 have downwardly projecting surfaces 24 configured with step portions 26. The step portions 26 are configured to define an arc of a circle having a predetermined radius such that the frame member 12 can be installed using a rotary grinder to form circular grooves in the pavement surface. The step portions 26 together with suitable adhesive serve to firmly embed the frame member 12 into the pavement. The support member 22 is also preferably formed with a bottom surface 28 that is arcuate in shape and has the same center of curvature as the keel members 20 (see FIG. 3).

Figure 2:
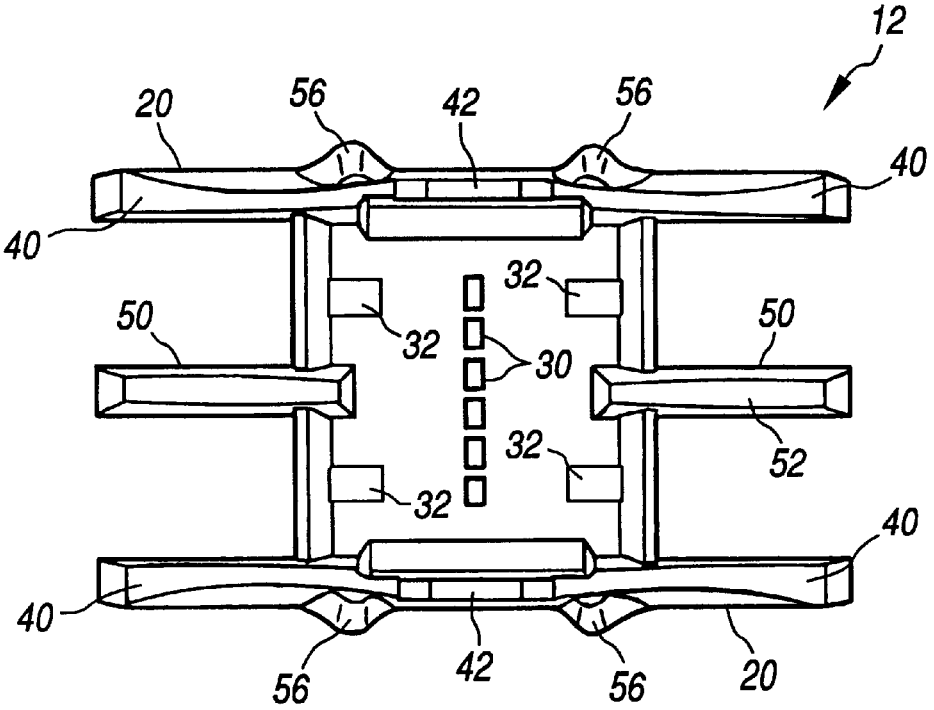
FIG. 2 is a top plan view thereof shown with the reflector removed.

Turning to FIG. 2, the support member 22 can be seen as being provided with a centrally disposed series of projections 30. These projections may be provided to be received with an interference fit by corresponding recesses formed in the underside of the reflector 14. The interference fit together with a suitable adhesive serve to secure the reflector 14 firmly to the support member 22. Recesses 32 may also be provided in the support member 22 extending slightly under edges 34 of the reflector 14 (FIG. 1). The recesses 34 allow a suitable prying tool, such as a screwdriver, to be inserted under the edges 34 of the reflector 14 when it is desired to remove the reflector 14 without disturbing the frame member 12 placement such as for reason of replacing a damaged reflector 14.

Figure 3:
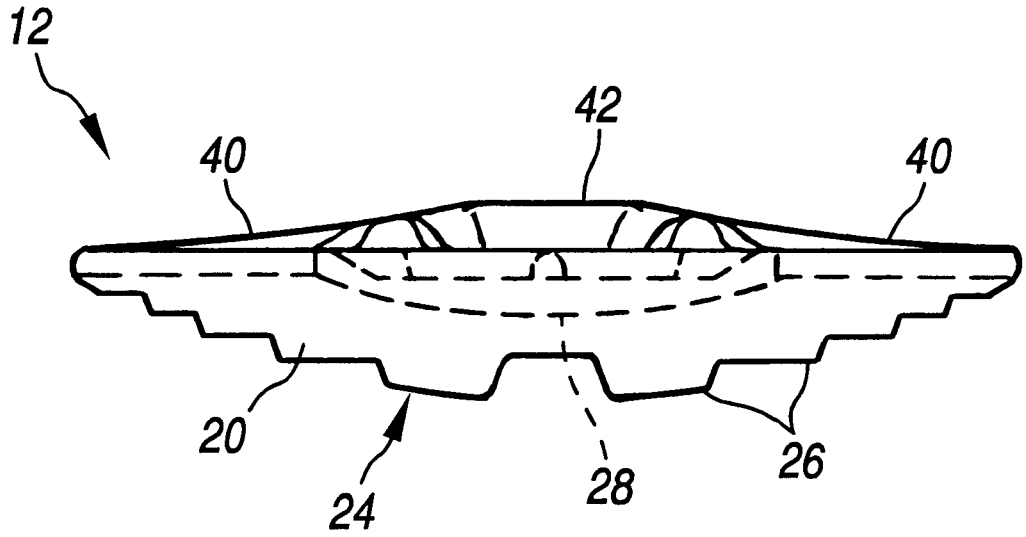
FIG. 3 is a side view thereof.
Figure 4:
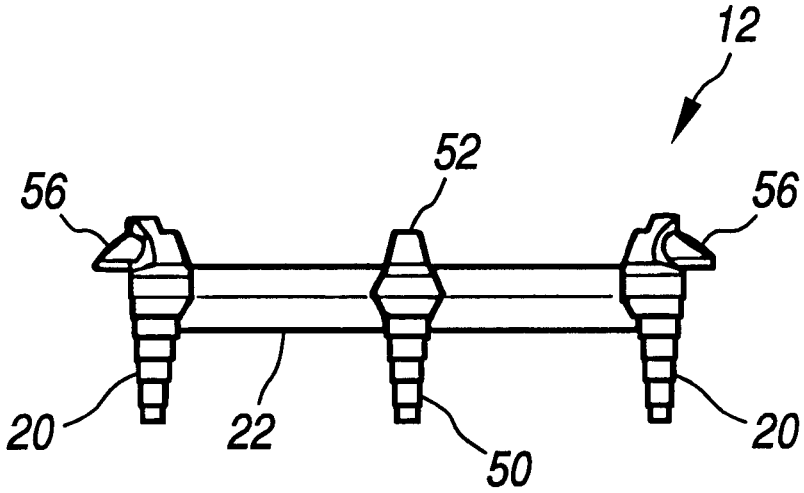
FIG. 4 is a front view thereof.

As best seen in FIG. 3, the primary keel members 30 are each provided with upwardly sloping ramp surfaces 40 which are joined by a linear flat surface 42 in the center of the frame member 12. The flat surface 42 extends approximately the same distance as the side 44 of the reflector 14 which preferably also has a flat planar top surface 46 (FIG. 1). The height of the surfaces 42 is also approximately equal to the height the reflector top surface 46. In accordance with the invention, the frame member 12 is provided with an auxiliary keel member 50 which is positioned between the primary keel members 20 along the central longitudinal axis of the frame member 12. The auxiliary keel member 50 has a bottom shape which is preferably identical to the bottom shapes of the primary keel members 20 including the same step configuration and same radius of curvature. The auxiliary keel member 50 also has upper ramp surfaces 52 which preferably have the same sloped shape as the ramp surfaces 40 of the primary keel members 20. In accordance with the invention the ramp surfaces 52 of the auxiliary keel member 50 extend inwardly of the frame member 12 to points 54 in close proximity with the edges 34 of the reflector 14. The primary keel members 20 in preferred form are provided with laterally projecting tab portions 56 which serve to properly set the height of the frame member 12 when installed on the pavement surface.

Figure 5:
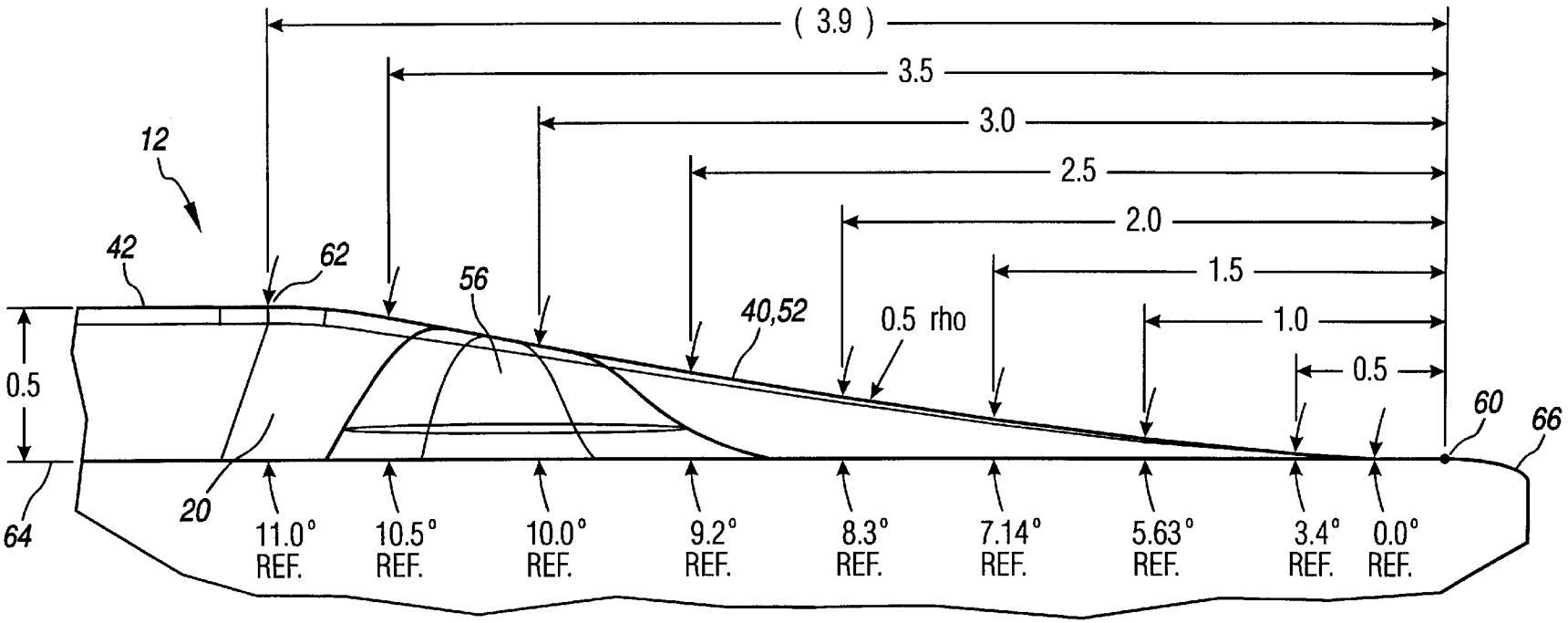
FIG. 5 is an enlarged fragmentary side view thereof illustrating the shape of a primary ramp surface as constructed according to the invention.

Referring now to FIG. 5 a profile of the ramp surfaces 40 and 52 of the keel members 20 and 50 is shown in side view on an enlarged scale. The tab portions 56 can also be seen to have a contoured shape to deflect a snowplow blade when the frame member 12 is struck from the side. In accordance with the invention the surfaces 40 and 52 can be seen in this Figure as having a distinctly upwardly concave profile beginning at a point 60 at a forward end of the surfaces 40 and 52 and terminating at a point 62 inwardly of the frame members 12 where the profile joins the flat surface 42. A line, designated 64, represents the pavement surface when the frame member 12 is installed. As is known in the prior art a forward portion 66 of the keel members 20 and 50 curves downwardly beneath the pavement surface 64 and thus avoids any forward edge of the keel members from protruding above the pavement surfaces that could be struck by a snowplow blade. Thus, it can be seen that at point 60 of the profile the ramp surfaces 40 and 52 preferably have a zero slope. In one preferred form, as shown in FIG. 5, the ramp surfaces 40 and 52 are substantially parabolic contour and rise continuously from the zero slope at point 60 to an 11.0 degree slope at point 62. For a standard size frame member 12 this rise in one preferred form, occurs over a 3.9 inch span and reaches a height above the pavement of 0.5 inch.

Figure 6:
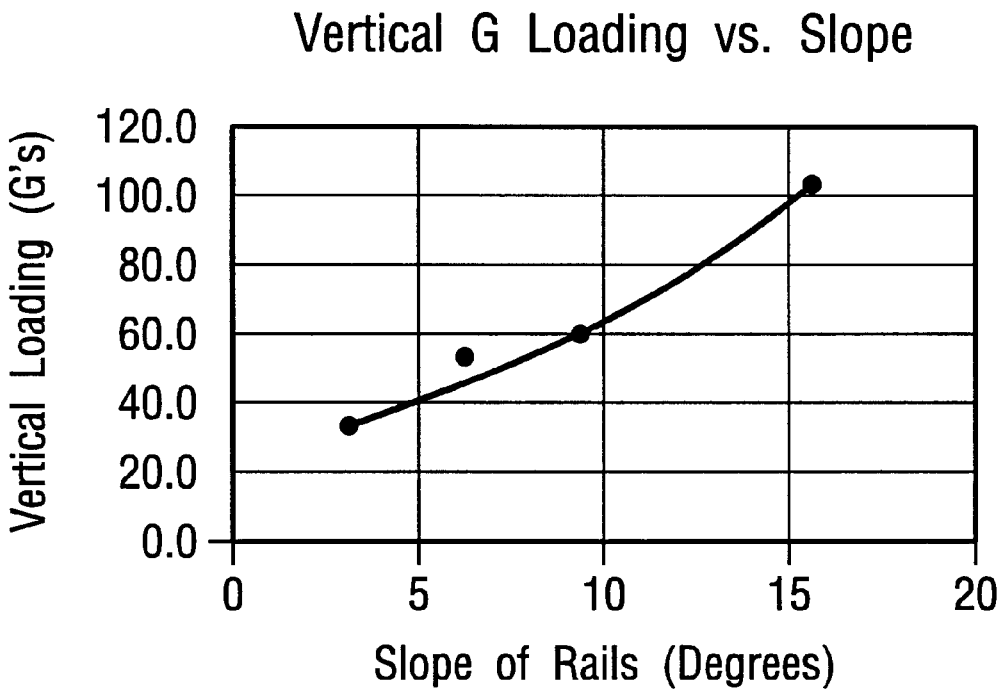
FIG. 6 is a graph showing the vertical loading versus slope of linear slope ramp surfaces of the prior art.

It can now be appreciated that a pavement marker 10 constructed according to the invention offers considerable advantages over prior art constructions by virtue primarily of its concavely parabolic ramp surface 40 and 52 configuration. A typical prior art pavement marker has a frame height of between 0.25 and 0.40 inches above the pavement surface and has linear sloped ramp surfaces. Illustrated in FIG. 6 is a graph showing acceleration forces for linear sloped ramp surface markers as derived from actual installations of prior art markers struck with a typical snowplow blade traveling at 25 m.p.h. and using accelerometer test instrumentation. It can be appreciated from FIG. 6 that for a hypothetical 0.5 inch high marker of the dimensions shown in FIG. 5 but having a linear sloped ramp surface instead of parabolic surface, the linear ramp surface would have a constant angle of 7.3 degrees which would yield an impact acceleration loading of approximately 50 g's. However, these same tests conducted on a pavement marker 10 of the present invention yielded an impact acceleration loading of on the order of 40 g's. Thus, these tests show that a 0.5 inch high marker having the parabolic ramp surface profile illustrated in FIG. 5 exhibits a strike force comparable to a 0.5 inch high marker having 3.5 degree linear sloped ramp surfaces.

The advantages of such a result can now be appreciated. The marker 10 has a higher profile than conventional designs which allows for the use of a larger reflector 14 over prior art linear sloped designs. With a larger reflector 14 the marker 10 can be constructed with auxiliary ramp surfaces 52 which can extend in close proximity to the reflector 14 without obscuring a substantial portion of the reflector 14 lenses 16. Thus, the auxiliary ramp surfaces 52 can, in turn, protect the reflector 14 from the impact of snowplow blades set at wide angles to their direction of travel. For example, it has been found that constructing a marker 10 with a frame length of approximately 10 inches and a width of approximately 5.86 inches, a snowplow blade can be set at in excess of 50 degrees from a line perpendicular to its direction of travel and still not contact the reflector when the blade strikes the marker 10 at pavement level. The center auxiliary keel member 50 with ramp surfaces 52 also adds structural integrity to the frame member 12 by reducing the bending moments imposed on the primary keel members 20. It has also been found that the marker 10 does not exhibit any noticeable adverse blade landing effects over conventional linear slope designs. Although the marker 10 has been described as having a specific parabolic ramp surface profile, as illustrated in FIG. 5, it will be appreciated that the invention is not limited to such a particular profile. Rather, depending upon the geometry and size of the marker frame other parabolic profiles may be equally suitable to achieve the objects of the invention. In addition, concave compound linear slopes have also been proven to be advantageous over prior art linear slopes.

While the invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A snowplowable pavement marker comprising:

a metallic frame including at least one primary keel having a lower portion configured to be disposed of beneath the surface of a portion of pavement on which the marker is to be installed and at least a pair of spaced apart parallel upper ramp surfaces;

a support member; and a reflector mounted on said support member;

said ramp surfaces each having at least a doubly upward inclined contour and having a forward end portion with a zero angle of inclination with respect to a horizontal line representing the surface of the pavement on which the marker is to be installed and inclined upwardly along a first portion of said ramp surface leading from said forward end portion at a first angle of inclination with respect to said horizontal line and with a second portion inclined upwardly at a larger angle of inclination than said first angle.

2. The pavement marker of claim 1 including an auxiliary keel member disposed between a pair of primary keel members.

3. The pavement marker of claim 2 wherein said auxiliary keel member has a ramp surface that extends from a forward end of said marker to a point in close proximity with said reflector.

4. The pavement marker of claim 3 wherein the ramp surface of said auxiliary keel member terminates at said point at a height approximately equal to the height of a top of said reflector.

5. The pavement marker of claim 2 wherein said auxiliary keel member is disposed along the longitudinal centerline of said marker.

6. The pavement marker of claim 2 wherein said auxiliary keel member has a ramp surface with substantially the same contour as the ramp surfaces of said primary keel members.

7. The pavement marker of claim 1 wherein each ramp surface joins a substantially horizontal surface disposed inwardly of said marker.

8. The pavement marker of claim 7 wherein said horizontal surface is approximately the same length as the length of a side wall of said reflector.

9. The pavement marker of claim 7 wherein said horizontal surface is at approximately the same height as the height of a top surface of said reflector.

10. The pavement marker of claim 1 wherein each primary keel member is provided with laterally projecting tab portions for supporting said pavement marker on a pavement surface.

11. The pavement marker of claim 10 wherein said tab portions have a rounded contour.

12. The pavement marker of claim 1 wherein said contour is substantially parabolic.

13. The pavement marker of claim 1 wherein said contour terminates inwardly of said marker at an angle of approximately eleven degrees with respect to a horizontal line representing a surface of pavement on which the marker is to be installed.

14. The pavement marker of claim 1 wherein said contour extends along said ramp surfaces for a distance of approximately 3.9 inches.

15. The pavement marker of claim 1 wherein said forward end of each ramp surface includes a surface portion projecting downwardly below said horizontal line.

16. The pavement marker of claim 1 wherein said contour is upwardly concave.

17. A metallic frame for providing protection of a reflector when mounted on a roadway pavement surface during a snowplowing operation comprising:

at least one primary keel having at least a pair of spaced apart parallel upper ramp surfaces and having a lower portion configured to be disposed beneath said pavement surface when said frame is installed thereon; and said ramp surfaces each having at least a doubly upwardly inclined contour and having a forward end portion with a zero angle of inclination with respect to a horizontal line representing said pavement surface, and inclined upwardly along a first portion of said ramp surface leading from said forward end portion at a first angle of inclination with respect to said horizontal line and with a second portion inclined upwardly at a larger angle of inclination than said first angle.

18. The frame of claim 17 including an auxiliary keel member disposed between a pair of primary keel members.

19. The frame of claim 18 including an auxiliary keel member is disposed along the longitudinal centerline of said frame.

20. The frame of claim 18 wherein said auxiliary keel member has a ramp surface with substantially the same contour as the ramp surfaces of said primary keel members.

21. The frame of claim 17 wherein said contour terminates inwardly of said marker at an angle of approximately eleven degrees relative to the pavement.

22. The frame of claim 17 wherein said contour extends along said ramp surfaces for a distance of approximately 3.9 inches.

23. The frame of claim 17 wherein each ramp surface joins a substantially horizontal surface disposed inwardly of said frame.

24. The frame of claim 17 wherein the forward end of each ramp surface includes a surface portion projecting below the surface of the pavement when the frame is installed.

25. The frame of claim 17 wherein each primary keel member is provided with laterally projecting tab portions for supporting said frame on the pavement surface.

26. The frame of claim 17 wherein said contour is substantially parabolic.

27. The pavement marker of claim 17 wherein said contour is upwardly concave.

* * * * *